United States Patent [19]

Petrusek

[11] 4,133,064

[45] Jan. 9, 1979

[54] INFLATABLE CHILD'S PILLOW

[76] Inventor: Victor Petrusek, 18511 Gottschalk St., Homewood, Ill. 60430

[21] Appl. No.: 786,107

[22] Filed: Apr. 11, 1977

[51] Int. Cl.[2] ..... A47G 9/00

[52] U.S. Cl. ..... 5/341; D6/203; 46/87

[58] Field of Search ..... 5/337, 341, 327 B, 344, 5/327 R, 338; D6/201, 202, 203; 247/181, 184; 46/156, 88, 87

[56] References Cited

U.S. PATENT DOCUMENTS

| | | | |
|---|---|---|---|
| D. 243,736 | 3/1977 | Ishizuka | D6/203 |
| 2,612,645 | 10/1952 | Boland | 5/344 |
| 3,003,815 | 10/1961 | Zinn | 5/337 |
| 3,017,221 | 1/1962 | Emery | 5/337 |
| 3,680,917 | 8/1972 | Harris | 5/365 |
| 3,824,917 | 8/1974 | De Laittre | 5/338 |
| 3,840,916 | 10/1974 | Jennings | 5/337 |

FOREIGN PATENT DOCUMENTS

| | | | |
|---|---|---|---|
| 657031 | 2/1963 | Canada | 46/87 |

*Primary Examiner*—Mervin Stein
*Assistant Examiner*—Alex Grosz
*Attorney, Agent, or Firm*—Tilton, Fallon, Lungmus & Chestnut

[57] ABSTRACT

An inflatable child's pillow formed of elastomeric sheet material which, upon inflation, has the configuration of the head of an animal with fully open jaws. The pillow includes a relatively flat bottom wall adapted to rest upon a bed or floor surface, a portion of such bottom wall defining the undersurface of the animal's lower jaw. It is the inflated lower jaw that serves as a resilient support for a child's head when the pillow is in use, the child's head thus being positioned within the animal's open mouth. Deformation of the pillow resulting from the weight of a child's head on the resilient lower jaw causes air displacement which in turn produces slight but noticeable movement of the animal's upper jaw. One or more partitions may be provided within the pillow to reinforce the pillow and limit the extent and/or rate of such air displacement.

6 Claims, 3 Drawing Figures

INFLATABLE CHILD'S PILLOW

BACKGROUND AND SUMMARY

Inflatable pillows of various types have been known in the past as disclosed, for example, in U.S. Pat. Nos. Des. 229,147 and Des. 190,548. In some cases, such pillows have been decorated to interest and amuse children. Also, noninflatable pillows, painted or otherwise decorated with the faces of storybook characters, have likewise been known in the past as indicated in U.S. Pat. No. 2,961,668 and U.S. Pat. No. Des. 160,223.

Unlike prior childrens' pillows, the pillow of this invention not only provides resilient support for a child's head but also constitutes an amusement device which stimulates a child's imagination and performs entertaining movements in response to the application, removal, and alteration of forces exerted by the child's head upon the pillow. Specifically, as the child rests his head upon the lower jaw of the animal pillow, or removes his head from that lower jaw, the displacement of air within the pillow produces noticeable changes in the relative position of the upper jaw of the pillow. A child's excitement or amusement in placing his head in the mouth of a friendly tiger, lion, crocodile, or other simulated animal is therefore enhanced by the jaw movements of that animal when such activity takes place.

Briefly, the pillow is formed of elastomeric sheet material and is shaped and decorated to simulate the head of an animal having its mouth fully open. The pillow is airinflated, the air being disposed in a chamber which extends through the head and into the upper and lower jaws thereof. The upper jaw and nose of the animal angle upwardly, whereas the lower jaw, with its generally flat bottom surface, is adapted to rest on any suitable support surface such as a bed or floor. Dimensions may vary considerably, depending on the particular animal used as a model for the pillow; however, the open mouth of the animal must be large enough to accommodate a child's head when the child places his head on the inflated lower jaw and, preferably, directly on the upwardly-bulging tongue of the lower jaw. Air displaced from the chin portion of the lower jaw travels rearwardly to increase pressure and alter the dimensions in other portions of the pillow, and such displacement thereby produces some flexing movement of the animal's upper jaw. Such flexing movement, which results in a partial opening or closing movement of the mouth of the animal pillow, tends to interest and delight children of all ages.

In the best mode presently known for practicing the invention, the inflatable pillow includes at least one internal partition which separates the interior of the pillow into a plurality of compartments. Such compartments preferably communicate with each other through bleed ports in the pillow. Thus, inflation of one compartment necessarily results in inflation of all compartments. The partition also tends to reinforce the pillow and, to the extent that its apertures restrict air flow, the rate and/or extent of air displacement when the pillow is in use may be controlled by increasing or decreasing the number or size of the apertures during manufacture.

Other advantages and objects of the invention will become evident from the specification and drawings.

DRAWINGS

DETAILED DESCRIPTION

Figure 1:
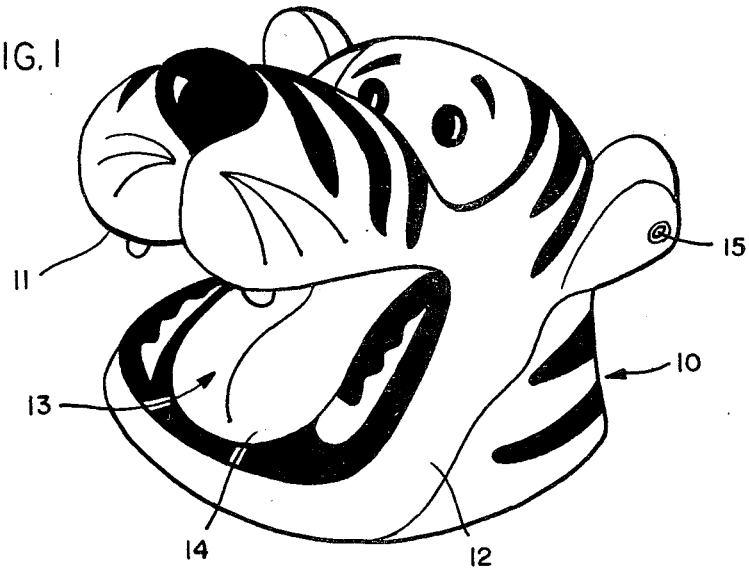
FIG. 1 is a perspective view of an inflatable pillow embodying the invention.

Referring to the drawings, the numeral 10 generally designates a child's pillow in the shape of the head of an animal. A tiger has been selected for illustrative purposes; however, the animal might be a lion, hippopotamus, crocodile, or any of a wide variety of other animals which are known to children and which are capable of being simulated with their mouths in fully open positions. Thus, in the embodiment depicted in the drawings, the tiger has its upper and lower jaws 11 and 12 spread apart to reveal its mouth 13 and tongue 14. The drawings (FIGS. 1 and 2) illustrate the stable condition of the pillow; that is, when inflated, the pillow assumes a condition in which the mouth of the simulated animal is substantially fully open.

The inflatable pillow is formed from highly flexible and pliable elastomeric sheet material. While any suitable plastic or plastic laminates having the properties of flexibility, durability, and air-impermeability might be used, particularly effective results have been achieved with elastomeric vinyls. The wall thickness of the pillow may vary widely depending in part on the material selected but, in general, such thickness will ordinarily fall within the range of about 10 to 100 mils, it being understood that wall thicknesses in the higher portion of that range may be preferred because of their greater strength and durability whereas thicknesses in the lower portion of the range have the advantage of lower cost. For purposes of inflating the pillow, a suitable inlet tube and valve 15 are provided. Since such sealable tubes are well known in the art, being commonly used with a wide variety of inflatable toys, a detailed discussion is believed unnecessary herein. Tube 15 is shown to be located in one ear of the animal but it will be appreciated that other locations may be selected.

Figure 2:
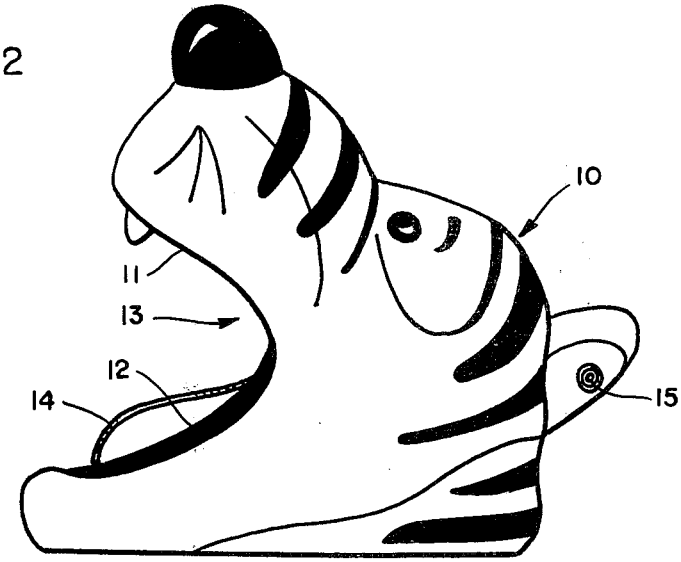
FIG. 2 is a side elevational view of the pillow.
Figure 3:
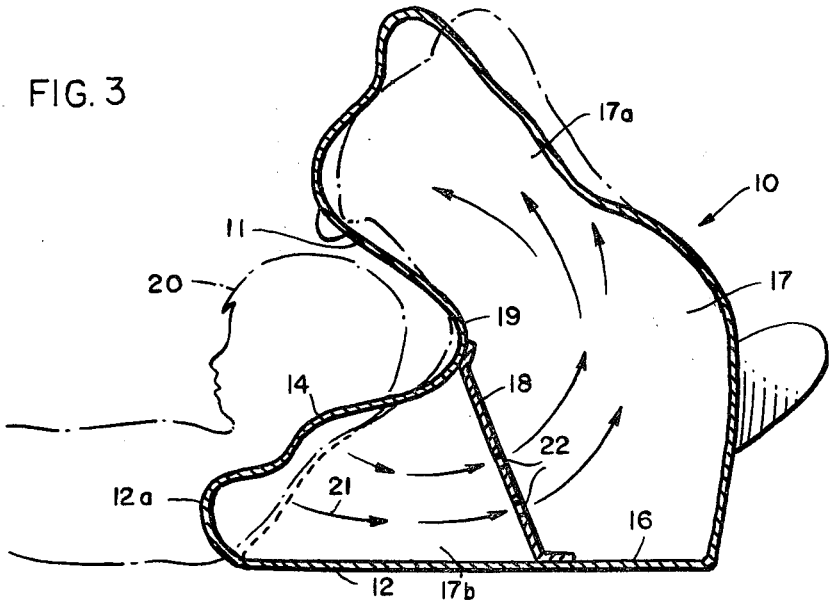
FIG. 3 is a vertical sectional view of the inflated pillow showing changes in the position and size of the upper jaw when the pillow is put to use.

FIGS. 2 and 3 reveal that the pillow has a substantially flat base or bottom wall 16 so that the pillow may be supported in stable condition on any suitable supporting surface. For example, the pillow may be placed upon the surface of a bed, or upon a floor surface, or on any other suitable supporting surface. The enlarged flat bottom wall 16 extends forwardly to define the underside of lower jaw 12. Therefore, not only does the bottom wall 16 provide a stable base for the head as a whole but it also forms a secure base for bracing the lower jaw 12 on a supporting surface.

In the best mode presently known for practicing the invention, the interior air chamber 17 of the inflatable pillow is provided with at least one partition 18 dividing that chamber into plural compartments **17*a* and 17*b*. Like the remainder of the pillow, the partition 18 may be formed of elastomeric sheet material. The edges of that partition are sealed by heat, solvent or any other suitable means to the interior wall surfaces of the pillow as shown. Preferably, the partition extends in a generally vertical direction between bottom wall 16 and the wall portion 19 which joins the upper and lower jaws at the back of the animal's mouth. The partition therefore performs the multiple functions of bracing walls 16 and 19**, as well as the side walls extending therebetween, and limiting the extent of expansive deformation of those walls when the pillow is inflated and especially when it is put to use.

While the overall dimensions of the pillow may vary considerably, the structure must be large enough so that the open mouth 13 is of a size sufficient to receive the head of a child 20 in the manner generally depicted in FIG. 3. The actual pillow surface — that is, the surface on which the child rests his head — is the exposed upper surface of the tongue-defining top wall 14 of lower jaw 12. Since the lower jaw (as well as the remainder of the pillow) is airinflated, the weight of a child's head, neck, and shoulders imposed on the lower jaw results in the displacement of air away from chin portion 12*a* in the general direction of arrows 21. Air is also displaced from beneath the tongue of the animal as the upper wall 14 conforms to the contour of the back of the child's head, neck, and shoulders. Such displacement of air results in alterations in the configuration of other portions of the animal head with such alterations generally involving movement of the upper jaw 12.

Partition 18 is shown as having apertures 22 which permit the flow of air between compartments 17*a* and 17*b*. When the pillow is in use, air displaced in the direction of arrows 21 may pass through the apertures into the upper jaw 17*a* and into other portions of the animal head. The air volume of the upper jaw 17*a* therefore increases at the same time that the volume of the lower jaw 17*b* decreases, causing changes in configuration which are exemplified by the dashed lines shown in FIG. 3. When child 20 places his head in the mouth of the simulated animal, or removes his head from that mouth, air displacement away from and back towards the chin and tongue portions 12*a* and 14, respectively, results in changes in the air volume of the remainder of the head to produce limited opening and closing movement of the upper jaw. Such movement enhances the function of the pillow as an amusement device for children.

The flexible partition 18 may be imperforate, in which case it will perform its reinforcing and bracing functions and, because of its flexibility, will not prevent, at least entirely, flexing movement of upper jaw 17*a* when compressive force is applied to and removed from the lower jaw. However, if the partition is imperforate, then additional inflation means similar to means 15 must be provided for separate inflation of lower jaw compartment 17*b*. In the preferred form of the invention, one or more apertures 22 are provided in the partition, thereby dispensing with the need for separate inflation means for each of the compartments. Moreover, the apertures to control the rate of flow of air between such compartments, thereby controlling the speed of the action of the upper jaw when compressive force is applied to or removed from the pillow's lower jaw.

While in the foregoing I have disclosed an embodiment of the invention in considerable detail for purposes of illustration, it will be understood by those skilled in the art that many of these details may be varied without departing from the spirit and scope of the invention.

I claim:

1. An air-inflatable pillow formed of deformable elastomeric sheet material shaped in the form of the head of an animal having upper and lower jaws spread apart to define an open mouth; said pillow providing an air-receiving chamber extending through said head and the upper and lower jaws thereof; means for inflating and deflating said pillow; said pillow including a bottom wall adapted to rest upon a supporting surface and forming the base of said lower jaw; said lower jaw upon inflation providing a resilient support for a child's head; and said open mouth being dimensioned to accommodate the child's head when the same is supported on said resilient lower jaw.

2. The pillow of claim 1 in which said lower jaw includes a top wall normally spaced from said bottom wall when said pillow is inflated, said top wall being shaped to define an upwardly-bulging tongue for resiliently supporting a child's head.

3. The pillow of claim 1 in which said lower jaw includes an inflatable chin portion at the distal end thereof, deformation of said chin portion when said pillow is compressed and released causing the flow of air to and from said chin portion and tending to produce changes in the shape of said pillow resulting in limited opening and closing movement of said upper jaw.

4. The pillow of claim 3 in which said chamber is provided with an internal partition formed from elastomeric sheet material and separating the interior of the pillow into compartments, one of said compartments being the interior of said lower jaw.

5. The pillow of claim 4 in which said partition extends generally vertically and is provided with a lower edge portion sealed to the inner surface of said bottom wall.

6. The pillow of claim 4 in which said partition is provided with at least one air flow aperture.

* * * * *